United States Patent [19]

Ryan

[11] Patent Number: 4,776,920

[45] Date of Patent: Oct. 11, 1988

[54] RUNNING WEB SPLICING APPARATUS

[75] Inventor: Ralph L. Ryan, East Hanover, N.J.

[73] Assignee: Compensating Tension Controls, Inc., West Caldwell, N.J.

[21] Appl. No.: 167,524

[22] Filed: Mar. 14, 1988

[51] Int. Cl.[4] ..... B65H 19/18

[52] U.S. Cl. ..... 156/504; 156/159

[58] Field of Search ..... 156/504, 502, 157, 159, 156/505, 507; 242/58.1, 58.4, 58.5

[56] References Cited

U.S. PATENT DOCUMENTS

| | | | |
|---|---|---|---|
| 3,537,939 | 11/1970 | Delaplaine et al. | 156/504 |
| 3,920,502 | 11/1975 | Tokuno | 156/504 |
| 4,490,199 | 12/1984 | Dunning | 156/502 |
| 4,555,281 | 11/1985 | Mattei et al. | 156/504 |
| 4,561,924 | 12/1985 | Hope et al. | 156/504 |

*Primary Examiner*—Michael Witshyn

*Attorney, Agent, or Firm*—Arthur L. Frederick

[57] ABSTRACT

The web splicing apparatus for connecting a running web extending and traveling between a supply of web material and a web using machine to the end portion of a new supply of web material comprises a frame to which is secured and supported a splicing device. The splicing device has web clamps and cutting members and functions to connect the severed end portion of a running web to the end portion of a new web. Two sets of slide shoes are secured to the frame to engage a pair of rails so that the frame is reciprocatively supported for movement in the direction of travel of a running web, when the splicing device is operative to effect a splice, to thereby supply web to the web using machine and moves in a direction counter to the direction of travel of the running web after the splicing is completed.

8 Claims, 3 Drawing Sheets

RUNNING WEB SPLICING APPARATUS

This invention relates to a running web splicing apparatus of the type disclosed in the U.S. Pat. No. 4,157,934 to Ryan et al and Ryan, U.S. Pat. No. 4,374,576 which functions to connect a running web, extending between a completing roll of web material and a using machine, to the end of a new roll of web material without interruption of the feed of web to the using machine.

BACKGROUND OF THE INVENTION

In heretofore known web lap or butt splicing apparatuses of the type disclosed in the aforementioned patents, a running web accumulator or festoon, as exemplified in the U.S. Pat. No. 3,886,031 to Taitel and Ryan, U.S. Pat. No. 4,374,576, is required to supply running web to the using machine, e.g. hammermill, during the period that the web is stopped for purposes of effecting the splice connection between the respective end portions of a depleting roll and new roll of web material. It has been found that the use of a festoon is not feasible for webs composed of filler absorbent material such as is used in diapers and sanitary napkins, known in the art as "pulp", before being fed into a hammermill where its density is decreased by a process known as "fluffing". A festoon is not practical because the rollers of the festoon around which the web of pulp has to be woven would be of exceptionally large size, as for example one foot in diameter, festoons requiring such large diameter rollers become impractically large in overall size. Also impractically large festoons would be required to accomodate webs of relatively stiff material as for example, cardboard and heavy paper of about 0.01 inches which must be woven around large diameter rollers to avoid fracture or tearing of the web. This problem of providing a using machine, such as a hammermill, with a supply of web of pulp material or relatively stiff material during splicing is solved by the web splicing machine of this invention.

Accordingly, an object of this invention is to provide a web splicing apparatus which is capable of providing a continuous running web to a using machine during splicing, but does not require a festoon. Another object of the present invention is to provide a splicing machine capable of handling a web of pulp or relatively stiff material.

SUMMARY OF THE INVENTION

Now, therefore, the present invention contemplates a novel web splicing apparatus for connecting a running web extending and traveling between a supply of web material, as for example, pulp, and a web using machine, as for example a hammermill, to the leading end portion of a new supply of web material, which comprises a frame and a splicing means, including web clamping means and web cutting means for clamping and cutting the running web and connecting the severed end portion of the running web to the leading end portion of a new web. The splicing means may function to butt or lap splice the webs together and may be of any suitable design such as is disclosed in the U.S. Pat. No. 3,886,031, to Taitel, Ryan, U.S. Pat. No. 4,190,483 and Ryan U.S. Pat. No. 4,374,576. The splicing means is attached to the frame. A support means is provided for supporting the frame for reciprocative movement along the line of travel of the running web so as to move in the direction of the travel of the running web during the splicing operation of the splicing means and thus provide a running web to the using machine and, thereafter, move in a direction counter to the direction of web travel after the splicing operation is completed.

In a narrower aspect of this invention, the means for supporting the frame includes a rail means and a rail engaging means secured to the frame.

A feature of this invention is a pair of spaced parallel rails disposed below the frame and two sets of slide shoes secured to the frame and constructed and arranged to suitably engage each of the rails.

BRIEF DESCRIPTION OF THE DRAWINGS

The invention will now be more clearly understood when considered in connection with the accompanying drawings, in which.

DESCRIPTION OF THE PREFERRED EMBODIMENT

Figure 1:
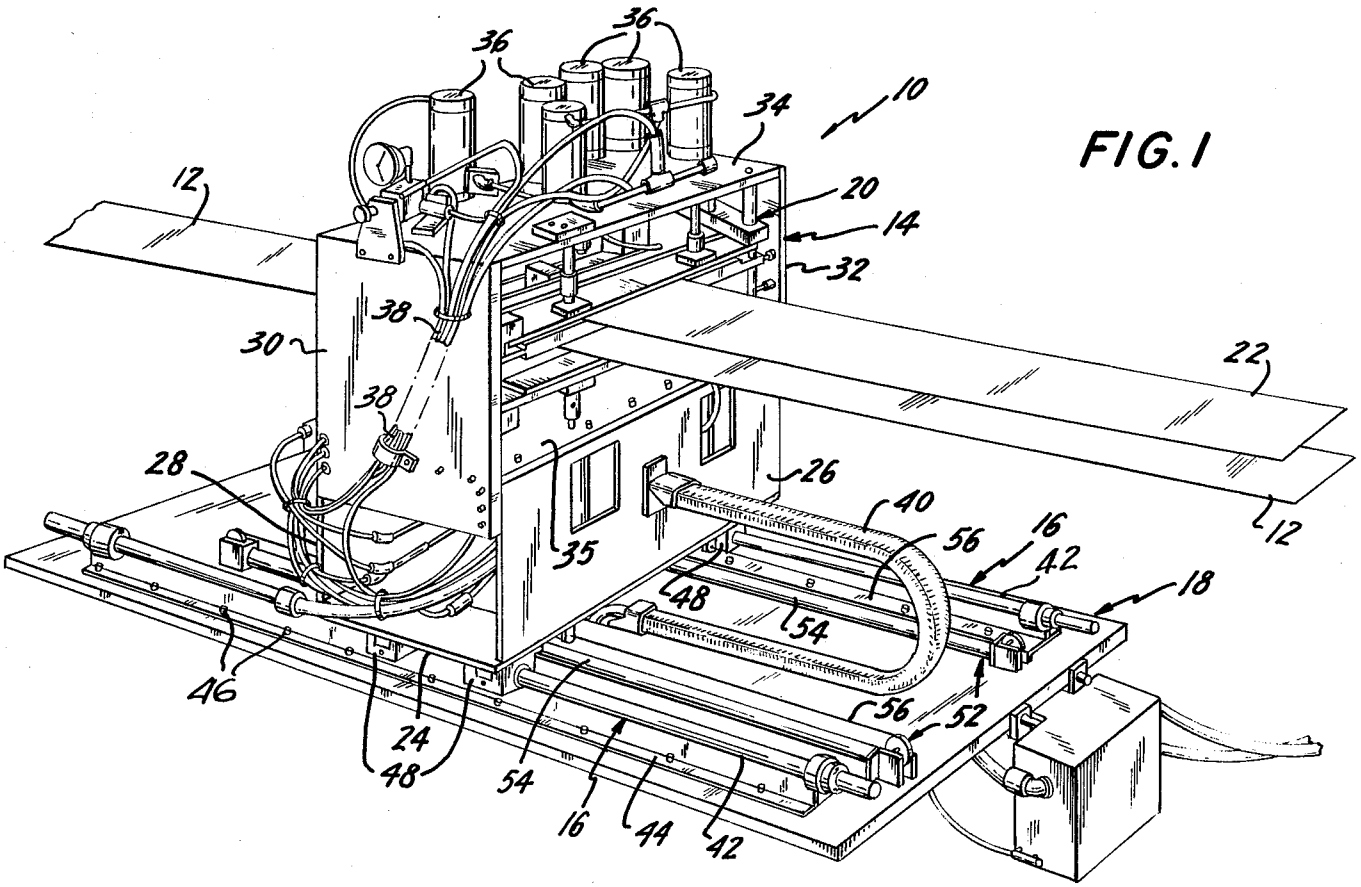
FIG. 1 is a perspective view of the web splicing apparatus according to this invention.

Now, referring to the drawings, more particularly FIG. 1, the reference number 10 generally designates the running web splicing apparatus according to this invention which is disposed to receive a running web 12 extending from a supply roll of web material (not shown) and pass such runnning web to a using machine (not shown), e.g. a hammermill.

The web splicing apparatus 10 comprises, in general, a supporting frame 14 mounted on two rails 16 for reciprocable movement on and relative to a base 18. A splicing device 20 of any suitable construction, such as disclosed in U.S. Pat. Nos. 3,886,031; 4,190,483 and 4,374,576, is carried by frame 14. A web 22 extending from a full roll of web material (not shown) may be positioned in the splicing device 20 preparatory to being spliced to the web portion of the severed end of the running web 12 when the supply roll nears depletion of web material.

Figure 2:
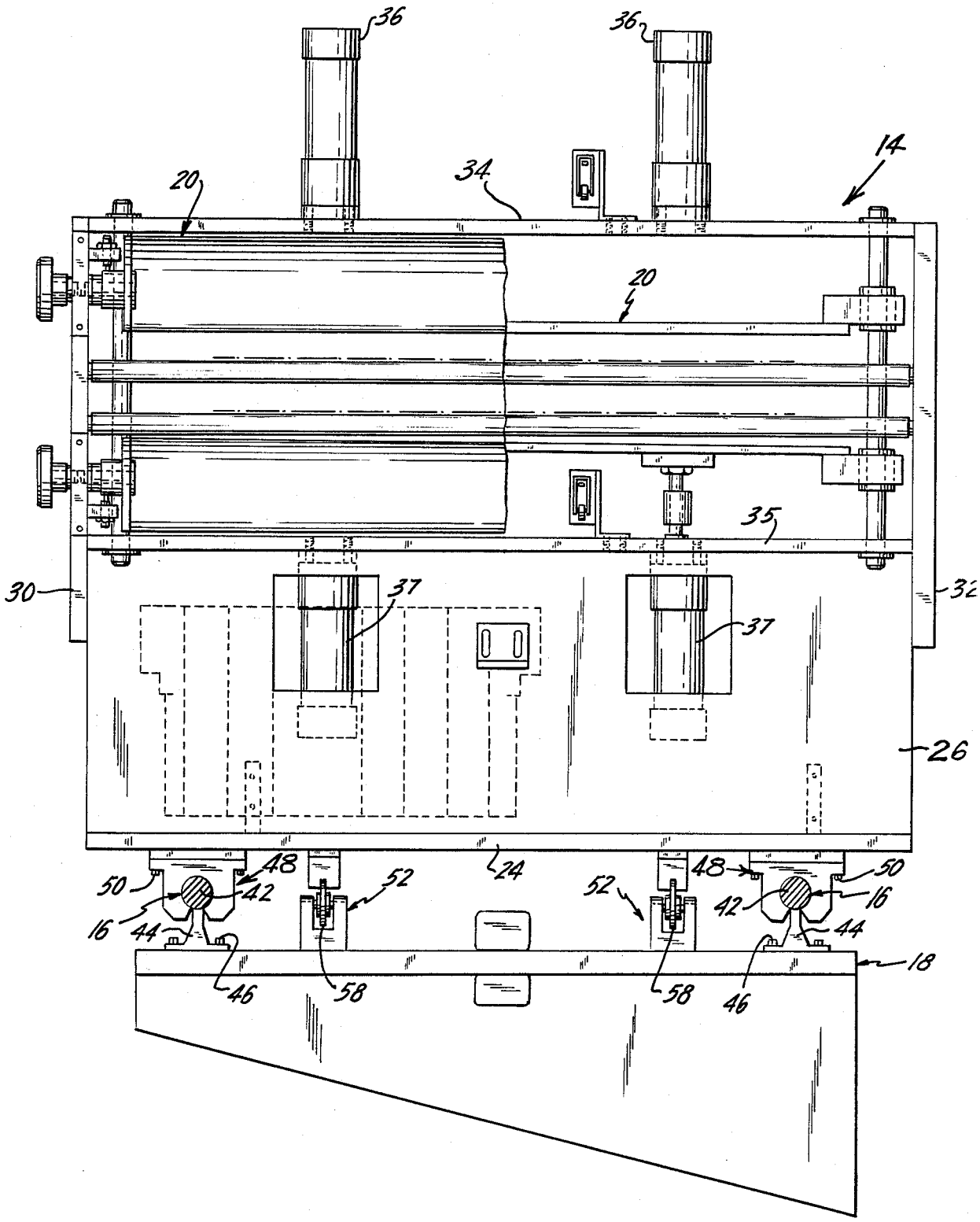
FIG. 2 is an end view of the web splicing apparatus shown in FIG. 1.
Figure 3:
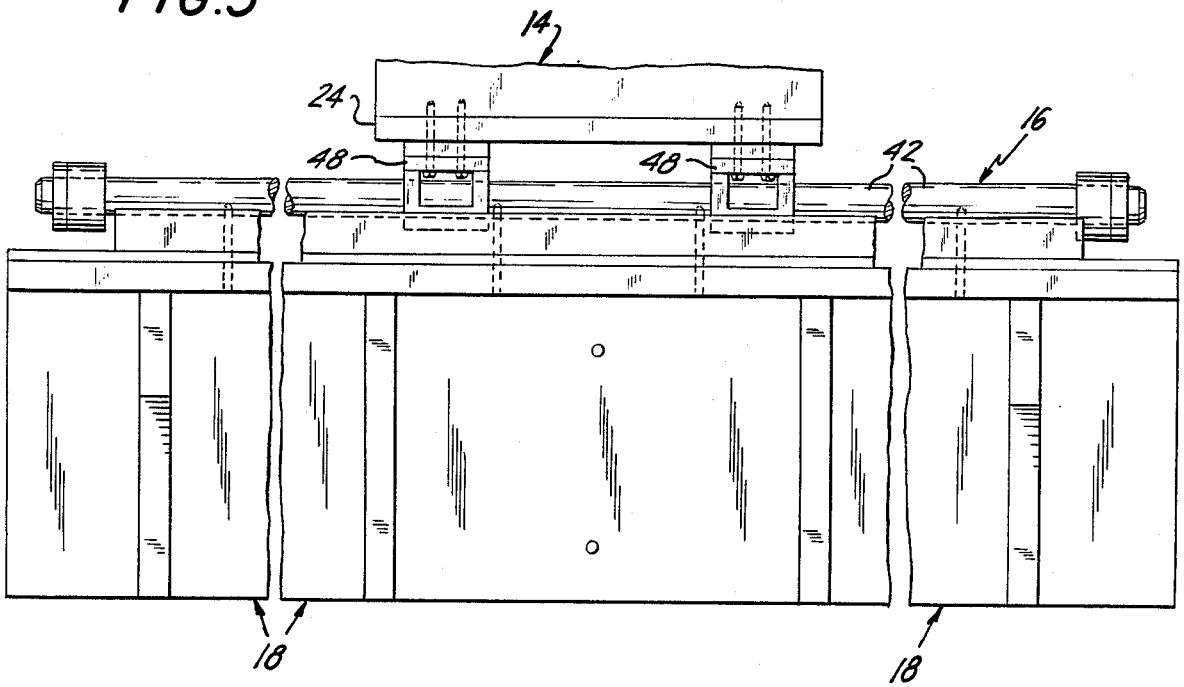
FIG. 3 is a side elevation view with parts broken away for clarity.
Figure 4:
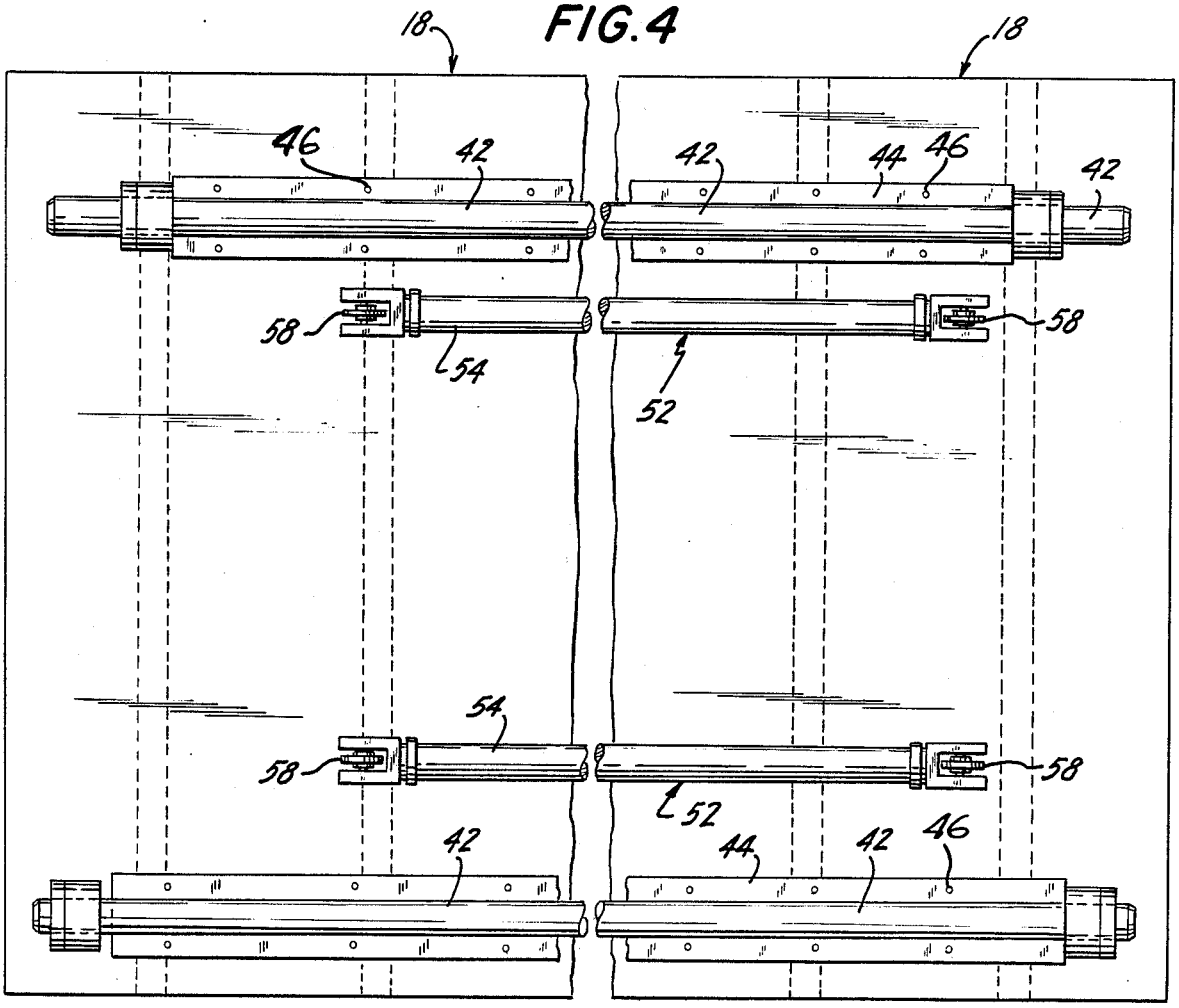
FIG. 4 is a top plan view of the frame support plate.

The frame 14 comprises a bottom wall 24 to which is secured, in any suitable manner, as for example by welding, a front wall 26 and rear wall 28. Opposite walls 30 and 32 are secured to front and rear walls 26 and 28. A top horizontal wall 34 is secured to the opposite side walls 30 and 32 and completes the frame. Front and rear walls 26 and 28 are dimensioned in width so that their respective upper edges are spaced from top wall 34 to thereby leave a space within which is mounted splicing device 20. An intermediate horizontal wall 35 is secured to the top edge of front and rear walls 26 and 28. The rectilinear pressurized fluid motors 36 are secured to top wall 34 and extend therethrough to splicing device 20. Similarly, two rectilinear motors 37 are mounted on intermediate wall 35 (see FIG. 2) and are also connected to the splicing device. More particularly, motors 36 and 37 are connected so as to effect actuation of the clamping and cutting elements of splicing device 20. Electrical cables and/or pneumatic lines 38 (see FIG. 1) for effecting operation of splicing device 20 are secured to frame 14 and extend through a flexible sheath 40, through the base 18, to a source of electrical power and/or pressurized fluid (not shown). The electrical lines 38 form part of the control system (not shown)

which provides for operational control of splicing device 20.

The rails 16, which support frame 14, comprise spaced parallel pipes or rods 42 which are mounted on T-shaped brackets 44. Each of the brackets 44 is secured to base 18 by a plurality of holdown bolts 46 or may be secured to the base in any other suitable manner. Each of the rails 16 is slidably engaged by a pair of spaced shoes 48, preferrably of the ball bushing type, which are secured to the underside of bottom wall 24. The ball bushings 48 are of conventional construction and, as for example, may be ball bushings, model PB-OPN Pillow Block, Part No. NPBO-24-OPN, manufactured by Thomson Industries, Inc. of Manhasset, N.Y. Shoes 48 of the ball bushing type provide high load capacity together with low frictional resistance. Each shoe is secured, in any suitable manner such as by bolts 50, to bottom wall 24 of the frame 14. To provide for the maintenance of a predetermined tension on running web 12 a biasing means 52 is connected between frame 14 and base 18.

The biasing means 52 may comprise one or more bi-directional pressurized fluid, linear motors 54 and may be of the type disclosed in the U.S. Pat. No. 3,886,031 to Taitel. Each of the motors 54 comprises a cylinder-piston assembly mounted on base 18 between rails 16. The piston of the cylinder piston assemblies has attached thereto both ends of a cable 56. The cable 56 passes over a pulley 58 at each end of the cylinder of the piston-cylinder assembly and is connected to frame 14. Pressurized fluid is passed into the cylinder by means, not shown, so that a predetermined constant force is applied to the piston which force is transmitted through cable 56 to frame 14 so as to keep the tension on the web constant as the frame moves during the splicing operation and return. The frame, after splicing, is returned to a starting position for a subsequent splicing operation.

In the event the running web is of a material of sufficient tensil strength so that the force applied to the running web 12 by the using machine during the splicing phase of operation can move the frame without tearing and thereby supply web material to the using machine during splicing, then biasing means 52 may comprise one or more uni-directional, pressurized fluid, linear motors to bias the frame in a direction counter to the direction of travel of the running web so as to return the frame to its starting position.

In operation of the running web splicing, apparatus 10, when it is desired to splice running web 12 to the leading end of web 22 of a full roll (not shown), the splicing operation is initiated by appropriate activation of the control system (not shown). When the running web 12 is clamped by splicing device 20 preparatory to being cut and secured to the leading end portion of web 22, the frame 14 is drawn on rails 16 in the direction of the using machine (not shown) to provide the latter with web material during the time the running web travel is interrupted for splicing, thus permitting continuous operation of the using machine. Upon completion of the splicing operation and the release of running web 12, frame 14 is returned to its starting position by motors 54 so that the apparatus is ready for a subsequent splicing operation.

It is believed now readily apparent that the present invention provides a novel running web splicing apparatus which is capable of splicing together webs of pulp material or relatively stiff material. It is a splicing apparatus which does not require a festoon assembly.

Although only one embodiment of the invention has been illustrated and described in detail, it is to be expressly understood that the invention is not limited thereto. Various changes can be made in the arrangement of parts without departing from the spirit and scope of the invention as the same will now be understood by those skilled in the art.

What is claimed is:

1. A web splicing apparatus for connecting a running web extending and traveling between a supply of web material and a web using machine to the end portion of a new supply of web material comprising:

(a) a frame, (b) splicing means, including web clamping and web cutting means for clamping and cutting the running web and connecting the severed end portion of the running web to the end portion of the new web, carried by said frame; and (c) means for supporting said frame for reciprocative movement along the line of travel of the running web so as to move in the direction of the web travel during the splicing operation of said splicing means and thereby provide running web to the using machine and move in a direction counter to the direction of web travel after the splicing operation is completed.

2. The apparatus of claim 1 wherein the said means for supporting the frame for reciprocative movement includes rail means and rail engaging means secured to the frame.

3. The apparatus of claim 2 wherein said rail means comprises two spaced, parallel rails.

4. The apparatus of claim 3 wherein said rail engaging means comprises a plurality of slide shoes secured to the underside of said frame.

5. The apparatus of claim 3 wherein each of said rails are elongated cylindrical elements mounted on a T-shaped bracket.

6. The apparatus of claim 1 wherein a biasing means is connected to said frame to exert a biasing force on said frame in an opposite direction from the direction of travel of the running web.

7. The apparatus of claim 6 wherein said biasing means is pressurized fluid, cylinder-piston assembly.

8. The apparatus of claim 2 wherein said means for supporting the frame includes a base plate to which said rail means is attached.

* * * * *